United States Patent [19]

Futamura

[11] 4,055,045

[45] Oct. 25, 1977

[54] PORT LINER SUPPORT DEVICE

[75] Inventor: Kazumasa Futamura, Toyota, Japan

[73] Assignee: Toyota Jidosha Kogyo Kabushiki Kaisha, Japan

[21] Appl. No.: 676,205

[22] Filed: Apr. 12, 1976

[30] Foreign Application Priority Data

Aug. 15, 1975 Japan ..... 50-112920

[51] Int. Cl.[2] ..... F01N 3/10; F01N 7/00

[52] U.S. Cl. ..... 60/322

[58] Field of Search ..... 60/282, 322, 323

[56] References Cited

U.S. PATENT DOCUMENTS

| | | | |
|---|---|---|---|
| 3,898,803 | 8/1975 | Sasaki | 60/282 |
| 3,902,853 | 9/1975 | Marsee | 60/322 |
| 3,965,881 | 6/1976 | Sakurai | 60/282 |
| 3,990,856 | 11/1976 | Suzuki | 60/282 |

FOREIGN PATENT DOCUMENTS

| | | | |
|---|---|---|---|
| 2,020,154 | 11/1970 | Germany | 60/322 |

*Primary Examiner*—Douglas Hart

*Attorney, Agent, or Firm*—Brisebois & Kruger

[57] ABSTRACT

A supporting device for a port liner through which engine exhaust gas is introduced into a manifold reactor. This supporting device comprises at least one projection for supporting the port liner between the cylinder head fixture and the outer shell of the manifold reactor.

5 Claims, 4 Drawing Figures

FIG. 3
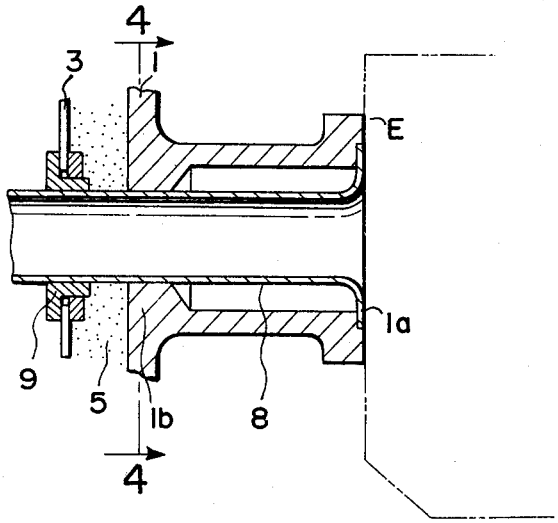
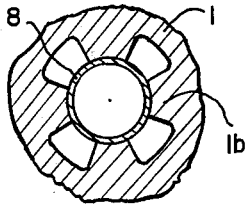
FIG. 4

PORT LINER SUPPORT DEVICE

BACKGROUND OF THE INVENTION

In a manifold reactor which is designed to purify exhaust gases by reburning them, the engine exhaust is introduced thereinto through a plurality of port liners. These port liners are inserted into the reburning chamber through the engine cylinder head fixture. One end of the port liner is supported at the cylinder head fixture which is the base point, while its other end is fitted to the gas-seal collar of the outer shell of the reburning chamber in the manifold reactor. Otherwise, the port liner is supported by an external protective casing with a heat insulator between them.

Such a method of support has the drawbacks that, when the port liner is long, the gas-seal collar suffers deformation or wear due to engine vibration; in consequence the heat-insulating material escapes through a fine gap between the sealing ring and the port liner into the manifold reactor and disperses therein, resulting in a drop in the purifying efficiency and other undesirable phenomena.

SUMMARY OF THE INVENTION

In a support casing for a port liner in a manifold reactor through which engine exhaust is introduced, a port liner support device is characterized in that an integral projection to fit and support the port liner at a specified distance from the cylinder head fixture is provided on the inside surface of said casing.

BRIEF DESCRIPTION OF THE DRAWINGS:

FIG. 3 is a sectional view of the port liner support device according to the present invention.

FIG. 4 is a sectional view taken along the line IV—IV of FIG. 3.

DETAILED DESCRIPTION OF THE INVENTION

The present invention will be described in comparison with a conventional manifold reactor.

Figure 1:
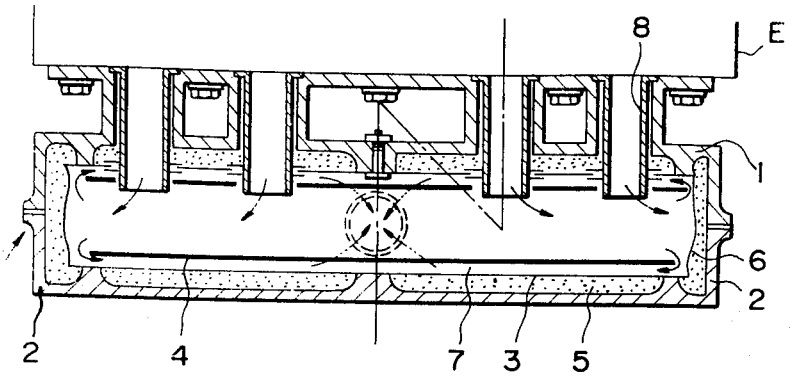
FIG. 1 PRIOR ART
FIG. 1 is a horizontal sectional view taken through a conventional manifold reactor.
Figure 2:
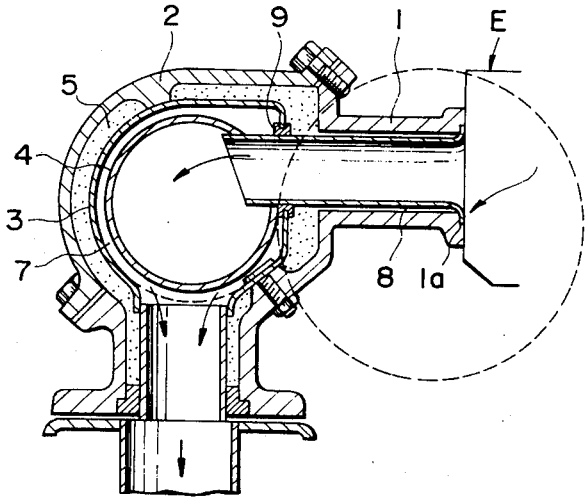
FIG. 2 PRIOR ART
FIG. 2 is a sectional view taken along the line II-II of FIG. 1.

As illustrated in the horizontal sectional view of FIG. 1 and in the longitudinal sectional view of FIG. 2, the manifold reactor is so constructed that, within a protective cylinder which consists of casing 1 supporting the port liner 8 and casing 2 supporting the reburning chamber, are an inner shell 4 which defines the reburning chamber and an outer shell 3 surrounding the inner shell 4. The space between the outer shell 3 or the port liner 8 and the casings 1, 2 is filled with a heat insulating material 5. Both ends of the outer shell 3 are sealed with a sealing strip 6.

As shown in FIG. 2, the port liner 8 is supported at the cylinder head fixture 1*a* of the casing 1. Therefore a particularly long inlet port liner 8 is subjected to the vibration of the engine E and the sealing ring 9 is subjected to a vibrational stress. The port liner 8 is fitted to the sealing ring 9 with a fine gap between them so that the sealing ring 9 is slidable thereon during thermal expansion of the outer shell 3. When an excessive vibrational stress develops in the port liner 8, sealing ring 9 is deformed or its sliding surface becomes heavily worn, causing gas leakage at this point, and the heat insulating material 5 filling the space between the protective cylinder and the outer shell 3 escapes together with the exhaust gas into the outer shell 3 and disperses therein. Dispersion of the heat insulating material 5 results in a deterioration in the heat insulation of the manifold reactor and in an increased heat transfer to the engine casing. Thus various difficulties arise and the exhaust gas purifying efficiency declines.

The present invention aims to eliminate the above drawbacks through improved construction of the port liner support device.

An embodiment exemplifying the present invention will now be described with reference to FIG. 3.

As illustrated in this figure, the port liner support device of the present invention is characterized in that, at a specified distance from the cylinder head fixture 1*a* of the casing 1, a projection 1*b* to fit and support the port liner 8 is formed integrally on the casing 1.

There may be a slight gap between the port liner 8 and the projection 1*b,* or the port liner 8 may be press-fitted into the annular projection 1*b* on the casing 1. Thus when the port liner 8 engages the projection 1*b* of the casing 1, the port liner 8 can be supported at two points; at the cylinder head fixture 1*a* and at the projection 1*b.*

Since in this arrangement the vibration of the port liner 8 itself does not occur even when an excessive vibrational stress is applied to the port liner 8, the sealing ring 9 will not vibrate so that the sliding surface thereon will not become worn.

The projection 1*b* according to the present invention may be integrally formed as a ring on the inner surface of the casing 1 opposite the outer surface of the port liner 8 or a plurality of projections may be provided at intervals about the same circumference, in which case the number of projections may be 3, 4 or more.

As illustrated in FIG. 3, the projection 1*b* may be made of the same material as the casing 1 or it may be made of any appropriate heat insulating material and attached to the inner surface of the casing 1.

There is no restriction to the installed position of the projection 1*b,* but it is advisable to set the projection 1*b* at the midpoint between the cylinder head fixture and the sealing ring of the outer shell 3 or at a position between the midpoint and the outer shell 3. The number of projections 1*b* is not necessarily one.

As explained above, the port liner support device according to the present invention, reduces deformation or wear of the sealing ring and, unlike the conventional construction, permits no gas leakage and no dispersion of the heat insulating material into the exhaust gas. With the heat insulating effect of the manifold reactor maintained there is no likelihood that various troubles will develop due to heat transfer to the engine casing and that the exhaust gas purifying efficiency will drop. Therefore the industrial value of the present invention is extremely high.

What is claimed is:

1. In a manifold reactor comprising an outer shell having an exhaust gas inlet port therein, a sealing ring surrounding said inlet port, and a liner for said port leading into said reactor through said sealing ring, an improved support casing for said liner, which support casing is adapted to be connected at one end to a cylinder head fixture and comprises a projection on its inner surface between the cylinder head fixture and said sealing ring, which projection is adapted to fit against and support said liner.

2. A port liner support casing as claimed in claim 1, in which said projection is integrally formed as a ring on the inner surface of the port liner support casing.

3. A port liner support casing as claimed in claim 1, in which a plurality of said projections are discontinuously formed on the inner surface of the port liner support casing.

4. A port liner support casing as claimed in claim 3, in which the number of said projections is 3 or 4.

5. A port liner support casing as claimed in claim 2, in which said projection is an annular projection made of heat insulating material is fixed to the inside surface of the port liner support casing.

* * * * *